US005471800A

United States Patent [19]

Hill et al.

[11] Patent Number: 5,471,800

[45] Date of Patent: Dec. 5, 1995

[54] FURNITURE DISPLAY

[75] Inventors: Andrew C. Hill, Joplin, Mo.; Ronald S. Foster, Hendersonville, Tenn.

[73] Assignee: Sunbeam Corporation, Fort Lauderdale, Fla.

[21] Appl. No.: 103,836

[22] Filed: Aug. 6, 1993

[51] Int. Cl.[6] ..... E04H 1/12

[52] U.S. Cl. ..... 52/239; 52/36.4; 52/36.5; 108/50; 108/60; 135/16

[58] Field of Search ..... 52/36.4, 36.5, 52/36.6, 36.1, 239; 297/184.1, 184.15, 184.16; 108/50, 60, 157; 135/16, 96, 98; 160/135; D25/56, 58

[56] References Cited

U.S. PATENT DOCUMENTS

| | | | |
|---|---|---|---|
| 2,245,705 | 6/1941 | Norris | 52/36.1 X |
| 3,561,376 | 2/1971 | Knoblock | 108/157 X |
| 3,834,092 | 9/1974 | Whisson | 52/36.4 |
| 4,315,467 | 2/1982 | Vanderminden | 108/157 |
| 4,805,541 | 2/1989 | Drane et al. | 108/157 X |
| 4,941,413 | 7/1990 | Vanderminden | 108/157 |
| 5,065,832 | 11/1991 | Mark | 108/50 X |
| 5,086,712 | 2/1992 | Clark | 135/16 X |
| 5,322,023 | 6/1994 | Hammond | 108/50 |

*Primary Examiner*—Carl D. Friedman
*Assistant Examiner*—Kien T. Nguyen
*Attorney, Agent, or Firm*—Michael J. Kline; Noland J. Cheung

[57] ABSTRACT

A furniture vignette display. The display includes a plurality of different furniture designs separated by a partition wall connecting each sectional furniture design. The display allows multiple styles of furniture to be shown in the same floor space normally occupied by one complete furniture set.

9 Claims, 4 Drawing Sheets

FURNITURE DISPLAY

FIELD OF THE INVENTION

The present invention relates to furniture displays, particularly a display including a number of sections of different designs of furniture, such as outdoor lawn furniture, including sectional table pieces and umbrella panels.

BACKGROUND OF THE INVENTION

As floor space on merchandising showroom floors becomes more expensive, and as more and more manufacturers compete for less and less of that floor space, the retailer is left with several undesirable options, particularly in the case of displays for large items, such as furniture. Attempts to include all furniture designs of all manufacturers are unrealistic, and result in over-crowded floor space and reduced aesthetic appeal to the consumer. Attempts to limit the number of designs and/or the number of manufacturers being displayed results in the consumer having fewer displays from which to make a point of purchase decision. Relying on brochures and catalogs to augment displays is not entirely satisfactory, as many consumers prefer to see the furniture in its three-dimensional state.

Accordingly, there is a need in the art to provide a furniture display that solves one or more of the aforementioned shortcomings of the prior art.

SUMMARY OF THE INVENTION

The present invention solves the aforementioned problems by providing a vignette display including a plurality of different furniture designs in approximately the same floor space that would have been occupied by one furniture design. The display includes only a sectional piece of furniture corresponding to each furniture design, each sectional piece in the display being fastened to at least one other sectional piece.

In a highly preferred embodiment of the invention, the display includes sections of tables, each section being separated by a wall structure, which may be used to display informational materials.

In another highly preferred embodiment of the invention, the display includes outdoor furniture having an umbrella subdivided into different umbrella panels, each panel corresponding to a design of the table section over which the umbrella is placed.

These and other objects and advantages of the present invention will become more readily apparent as the following detailed description of the presently preferred embodiments proceeds.

DETAILED DESCRIPTION OF THE PRESENTLY PREFERRED EMBODIMENTS

Figure 1:
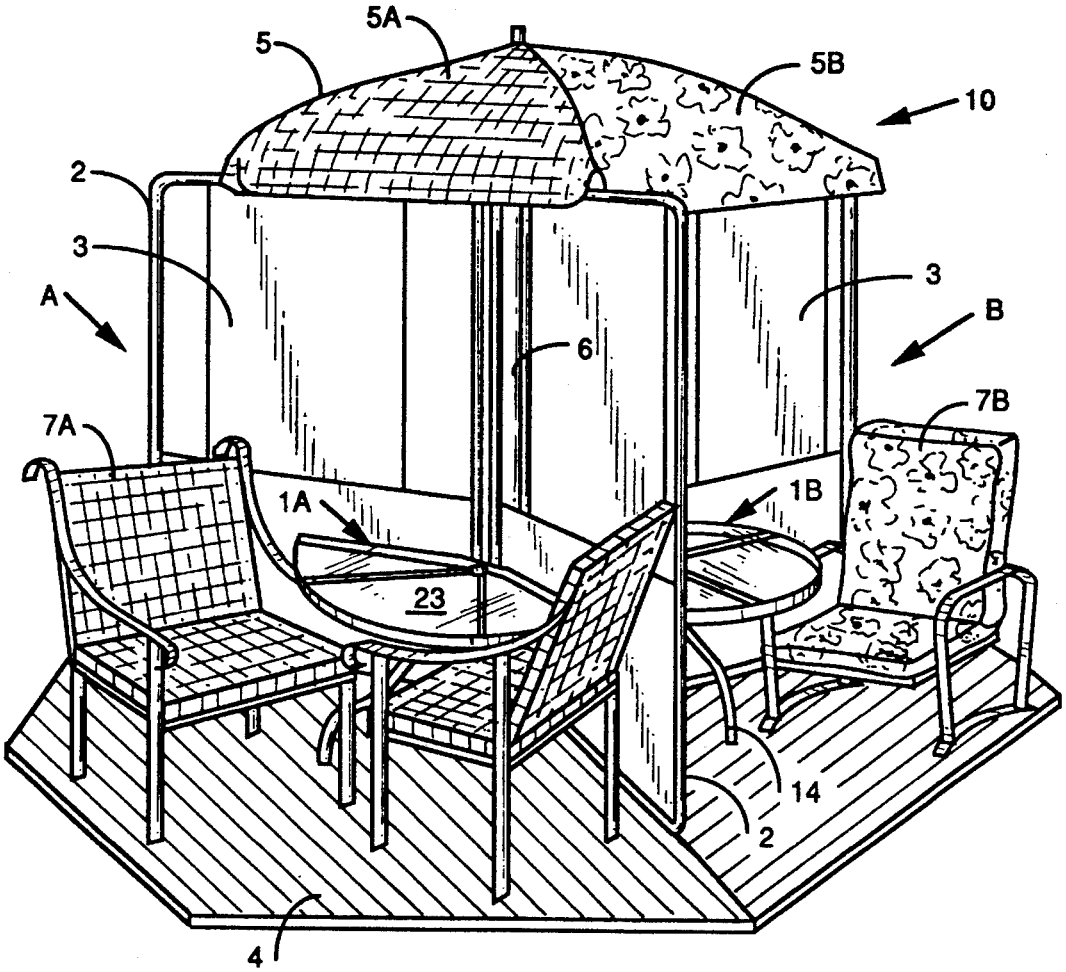
FIG. 1 illustrates an isometric elevational view of a preferred furniture display of the present invention.

Referring to FIG. 1, there is illustrated a furniture display of the present invention, generally 10. The display 10 as illustrated displays a plurality of different furniture designs A and B. Additional designs can be displayed to the rear of designs A and B, as will now be appreciated.

As illustrated in FIG. 1, each furniture design A and B is fastened to at least one other furniture design to provide a unitary display. In the embodiment of FIG. 1, the display includes two or more sectional tables 1A and 1B separated by a planar wall member 2.

The planar wall member 2 may further include a display panel 3 for displaying the brand name of the furniture and/or other informational material, including posters illustrating the furniture being displayed in a typical setting. The display may further include a base member, generally 4, to which the table tops 1A and 1B and/or the planar wall members 2 may be securely fastened. As illustrated, the base member 4 may comprise sections of wood aligned in a deck-like manner.

In a highly preferred embodiment of the invention, the display includes an umbrella 5 supported by an umbrella pole 6. Preferably, the umbrella 5 includes a plurality of sections, for example 5A and 5B, each section having a different design, which design preferably matches the fabric design of chairs 7A and 7B, respectively, in the display 10. As illustrated in FIG. 1, each umbrella section 5A and 5B is sized to be positioned over the section of its corresponding design, table 1A and 1B, and chairs 7A and 7B, respectively.

Figure 2:
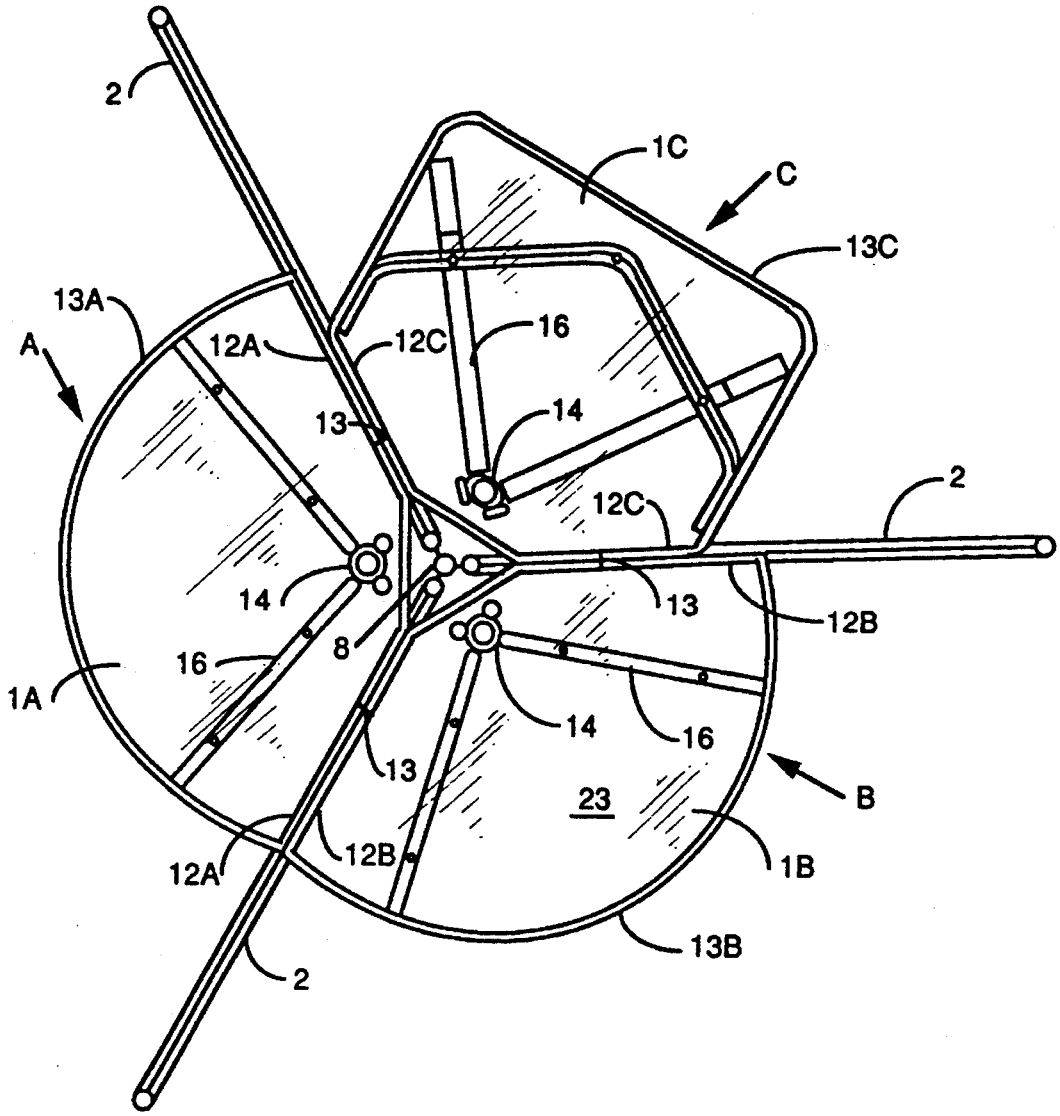
FIG. 2 illustrates a top plan view of a preferred embodiment of the invention showing three table tops joined by three wall members.

Referring now to FIG. 2, a highly preferred embodiment of the invention is illustrated wherein the display 10 is divided into equal sections A, B, and C. In this example, the sections A, B, and C comprise three equal sections separated by three planar wall members 2, each wall being positioned at an angle of 120° with respect to each other wall. Of course, other angles and other numbers of sections, equal and unequal, can be employed, as will now be apparent to those of ordinary skill in the art.

Figure 3:
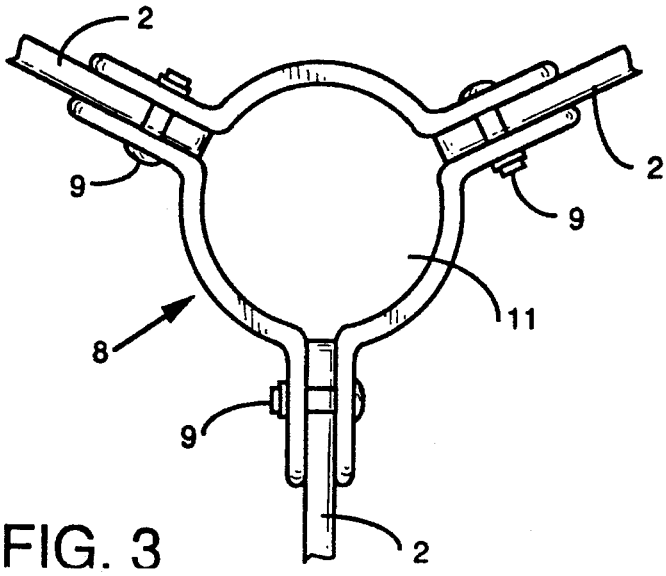
FIG. 3 is a top plan view of a preferred mounting bracket of the present invention.

The planar wall members 2 are preferably fastened together at a centralized location by a mounting bracket 8, best seen in FIG. 3. The mounting bracket 8 is adapted to fasten adjoining planar wall members 2 together, for example, with the use of fasteners 9, which may comprise nuts/bolts, screws, rivets, or any other fastener known to those of ordinary skill in the art. Most preferably, the mounting bracket 8 includes a central opening 11 for receiving the umbrella pole 6 and supporting same on the display.

As further illustrated in FIG. 2, each table, 1A, 1B, 1C is shaped to include at least one inner edge 12A, 12B, 12C, respectively, for abutting a complementary inner edge 12 of an adjacent sectional table portion. These inner edges may be fastened together, for example, by fasteners 13 passing through each adjoining table inner edge, for example, 12C and 12B and through the planar wall member 2 therebetween. The fasteners 13 may be the same as the fasteners 9 previously described.

As best seen in FIG. 2, each table 1A, 1B, 1C, includes an outer edge, 13A, 13B, 13C, respectively, having a shape corresponding to a section of the perimeter of a full table top design represented by each sectional table portion. For example, sections 1A and 1B have outer edges 13A and 13B which corresponding to a circular table top. Table top 1C has an outer edge 13C which corresponds to a square or a rectangular table top. Other arrangements will now be appreciated by those of ordinary skill in the art. Any of the table sections may include a hole bored in the table top for receiving an umbrella pole 6.

Figure 4:
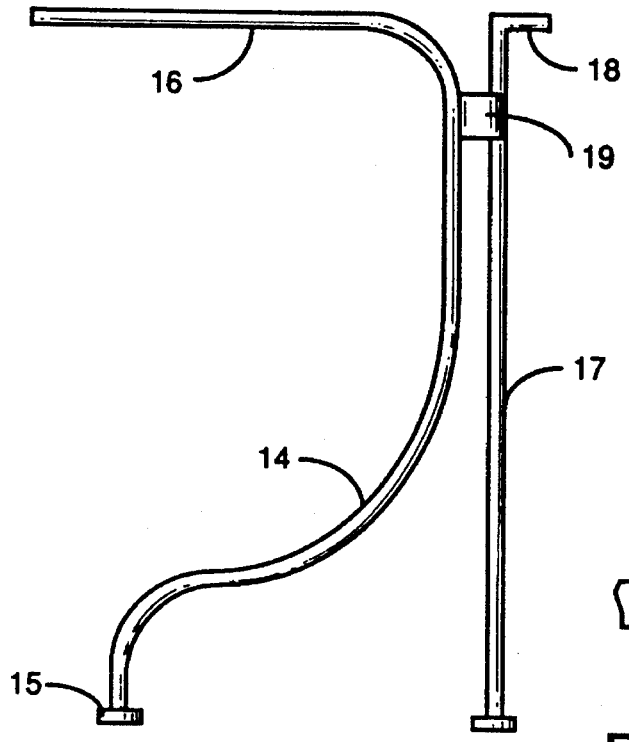
FIG. 4 is an elevational plan view of a preferred support leg assembly for a sectional table top of the present invention.

Referring to FIGS. 4, 5, 6, and 6A, the table leg and table top brace assemblies of the present invention will now be described. Each table top 1 preferably includes at least one leg 14 supporting the table top. As illustrated in FIG. 4, this leg 14 may comprise a unitary piece having a foot portion 15 and a table top support 16.

As further illustrated in FIG. 4, each leg 14 may further include a support pole 17 for providing added support to the table section being supported by the leg and pole, 14 and 17, respectively. The pole 17 may include a horizontal portion 18 for providing further support to the table top.

Figure 5:
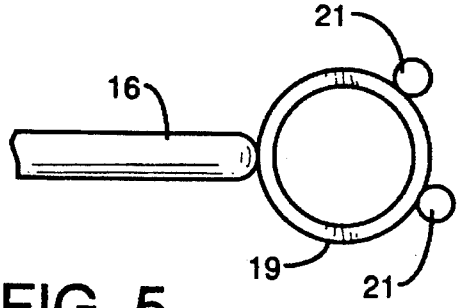
FIG. 5 is a top plan view of a portion of the support leg of FIG. 4 enlarged for detail.
Figure 6:
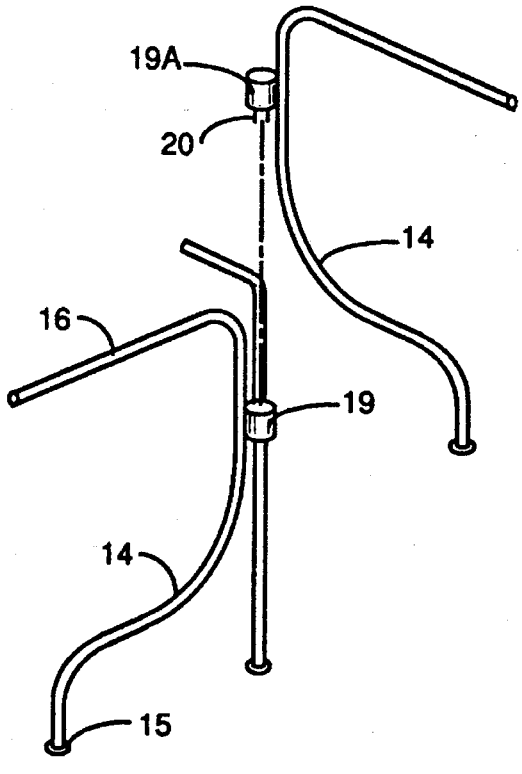
FIG. 6 is an isometric exploded view of a preferred table leg assembly of the display of the present invention.
Figure 6A:
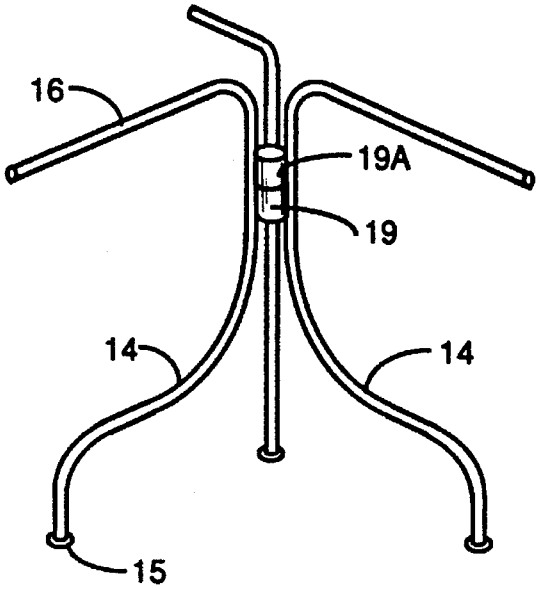
FIG. 6A is an isometric assembled view of the table leg assembly of FIG. 6.

Referring now to FIGS. 5 and 6, each leg 14 may further included an alignment bracket 19 for receiving alignment pins 20 contained in another leg assembly 14. The alignment bracket 19 may include flanges 21 for receiving the pins 20. The flanges 21 may be spaced at any desireable angle, such as those indicated, for providing a multiple leg assembly under each table section, as illustrated in FIG. 6A. As illustrated in FIG. 1, each table top may comprise a transparent top section 23 fabricated of any suitable material, such as glass or acrylic, known to those of ordinary skill in the art.

Figure 7:
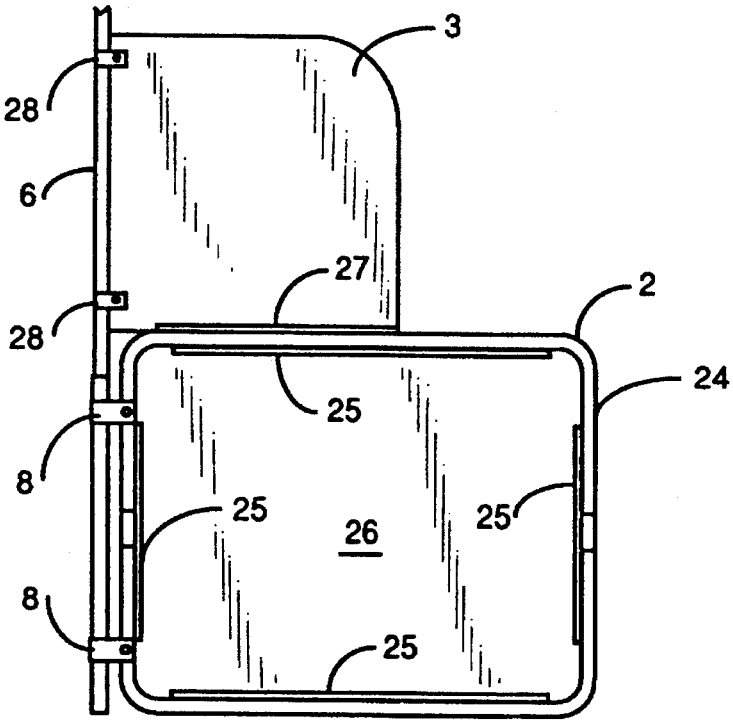
FIG. 7 is an elevational side view of a planar wall member of the invention.

Referring now to FIG. 7, each wall assembly 2 preferably includes two mounting brackets 8 through which the umbrella pole 6 passes. The wall assembly 2 may include a frame member 24 which may be any suitable material, preferably a plastic or aluminum tube material. The wall assembly 2 preferably includes a series of channels 25 spaced around the inside perimeter for receiving the planar wall panel 26. The wall panel 26 may comprise any suitable material known to those of ordinary skill in the art, including sheet metal, plastic, cardboard, etc. The display panel 3 is preferably positioned atop the wall assembly 2 within a top channel 27 as illustrated. This display panel 3 may be fabricated of materials similar to the wall panel 26. The display panel 3 is also preferably secured to the umbrella pole 6 by mounting brackets 28.

The display of the present invention may be used with any furniture, including tables, chairs, cabinets, beds, sofas, and any other type of furniture which may be sectioned and fastened together in the manner described for providing a compact unitary display.

When outdoor furniture comprises the display of the invention, any type of outdoor furniture may be employed, including wrought iron furniture, aluminum furniture, plastic furniture, wood furniture, in any style known to those ordinarily skilled in the art.

Although the invention has been described in detail in the foregoing for the purpose of illustration, it is to be understood that such detail is solely for that purpose, and that variations can be made therein by those of ordinary skill in the art without departing from the spirit and scope of the invention as defined by the following claims. All such variations are specifically intended to be embraced within the scope of the following claims, including all equivalents thereof.

I claim:

1. A display for displaying a plurality of different furniture designs, said display comprising at least two sectional table portions, each said sectional table portion corresponding to a different said furniture design, said display being divided into a plurality of sections, each said section being defined by a pair of planar wall members, each said section including said sectional table, each said sectional table portion having a top, each sectional table portion being joined to an adjacent said sectional table portion by fastening means passing through a planar wall member therebetween.

2. The display of claim 1, wherein said planar wall members are fastened together at a central location of said display by a mounting bracket.

3. The display of claim 2, further including an umbrella pole passing through and supported by said mounting bracket.

4. The display of claim 3, wherein said umbrella includes a plurality of umbrella panels, each said panel sized for placement over one of said sectionable table portions.

5. The display of claim 1, further including a base member to which said display is secured.

6. The display of claim 5, further including at least one chair in at least one said display section, each said chair having a furniture design corresponding to the furniture design of the display section in which it is placed.

7. The display of claim 1, wherein at least one of said sectional table portions includes a transparent top supported by a top support in said table portion.

8. The display of claim 1, wherein said sectional table portion having said top includes at least one supporting leg.

9. The display of claim 1, wherein said display is divided into equal sections.

* * * * *